US011613423B2

(12) United States Patent
Bivins

(10) Patent No.: US 11,613,423 B2
(45) Date of Patent: Mar. 28, 2023

(54) ANIMAL WASTE CONTAINMENT ASSEMBLY

(71) Applicant: Greg Bivins, Akron, OH (US)

(72) Inventor: Greg Bivins, Akron, OH (US)

( * ) Notice: Subject to any disclaimer, the term of this patent is extended or adjusted under 35 U.S.C. 154(b) by 0 days.

(21) Appl. No.: 17/376,272

(22) Filed: Jul. 15, 2021

(65) Prior Publication Data

US 2023/0014256 A1 Jan. 19, 2023

(51) Int. Cl.

| | |
|---|---|
| ***B65F 1/10*** | (2006.01) |
| ***B65F 1/16*** | (2006.01) |
| ***B65F 1/06*** | (2006.01) |
| ***B65F 1/12*** | (2006.01) |

(52) U.S. Cl.

CPC ..... *B65F 1/163* (2013.01); *B65F 1/06* (2013.01); *B65F 1/12* (2013.01); *B65F 1/1646* (2013.01); *B65F 2210/129* (2013.01); *B65F 2210/181* (2013.01)

(58) Field of Classification Search

CPC .... B65F 1/163; B65F 1/06; B65F 1/12; B65F 1/1646; B65F 2210/129; B65F 2210/181

USPC ..... 220/263, 495.01, 495.05, 495.06, 908, 220/908.1, 908.2

See application file for complete search history.

(56) References Cited

U.S. PATENT DOCUMENTS

| | | | | |
|---|---|---|---|---|
| 5,440,978 | A | 8/1995 | O'Brien | |
| 6,010,024 | A | 1/2000 | Wang | |
| 6,152,079 | A | 11/2000 | Chandler | |
| 8,544,413 | B1 | 10/2013 | Gnanendran | |
| 8,947,022 | B2 | 2/2015 | Shek | |
| D835,376 | S | 12/2018 | Yang | |
| 2010/0044380 | A1* | 2/2010 | Nallakrishnan | B65F 1/06 220/495.08 |
| 2012/0234849 | A1 | 9/2012 | Hughes | |
| 2013/0341328 | A1* | 12/2013 | Schneider | B65F 1/16 220/259.2 |
| 2018/0057257 | A1* | 3/2018 | Campbell | B65F 1/12 |

FOREIGN PATENT DOCUMENTS

| | | |
|---|---|---|
| WO | WO2012125666 | 9/2012 |

* cited by examiner

*Primary Examiner* — John K Fristoe, Jr.
*Assistant Examiner* — Elizabeth J Volz

(57) ABSTRACT

An animal waste containment assembly includes a container that is positioned outdoors to be accessible to people walking their pets. A drawer is slidably integrated into the container and the drawer supports a garbage bag for collecting animal waste that is deposited in the container. A lid is hingedly coupled to the container and the lid covers the opening in the container when the lid is positioned in a closed position. A deodorizer dispenser is disposed on the lid to dispense a measured amount of the chemical deodorant when the lid is opened. A foot pedal is movably disposed in the container and a linkage is movably coupled between the foot pedal and the lid. The lid is urged into the open position when the foot pedal is stepped upon to facilitate the person to deposit the bagged animal waste into the container.

7 Claims, 5 Drawing Sheets

ANIMAL WASTE CONTAINMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to waste containment devices and more particularly pertains to a new waste containment device for collecting bagged animal waste from people walking their pets. The device includes a container, a drawer slidably integrated into the container, a lid disposed on the container, a food pedal and a deodorant dispenser. The lid is opened when the foot pedal is stepped upon to facilitate the bagged animal waste to be deposited in the container and the deodorant dispenser releases a deodorant for concealing unpleasant odors.

(2) Description of Related Art Including Information Disclosed Under 37 CFR 1.97 and 1.98

The prior art relates to waste containment devices including a variety of garbage receptacles that have a lid which is operated with a foot pedal. The prior art discloses a variety of animal waste bag collection devices that each includes a bag dispenser and a canister for collecting bagged animal waste. The prior art discloses a waste receptacle that includes a lid which is operated with a foot pedal and a deodorant dispenser that releases a deodorant when the foot pedal is manipulated.

BRIEF SUMMARY OF THE INVENTION

An embodiment of the disclosure meets the needs presented above by generally comprising a container that is positioned outdoors to be accessible to people walking their pets. A drawer is slidably integrated into the container and the drawer supports a garbage bag for collecting animal waste that is deposited in the container. A lid is hingedly coupled to the container and the lid covers the opening in the container when the lid is positioned in a closed position. A deodorizer dispenser is disposed on the lid to dispense a measured amount of the chemical deodorant when the lid is opened. A foot pedal is movably disposed in the container and a linkage is movably coupled between the foot pedal and the lid. The lid is urged into the open position when the foot pedal is stepped upon to facilitate the person to deposit the bagged animal waste into the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
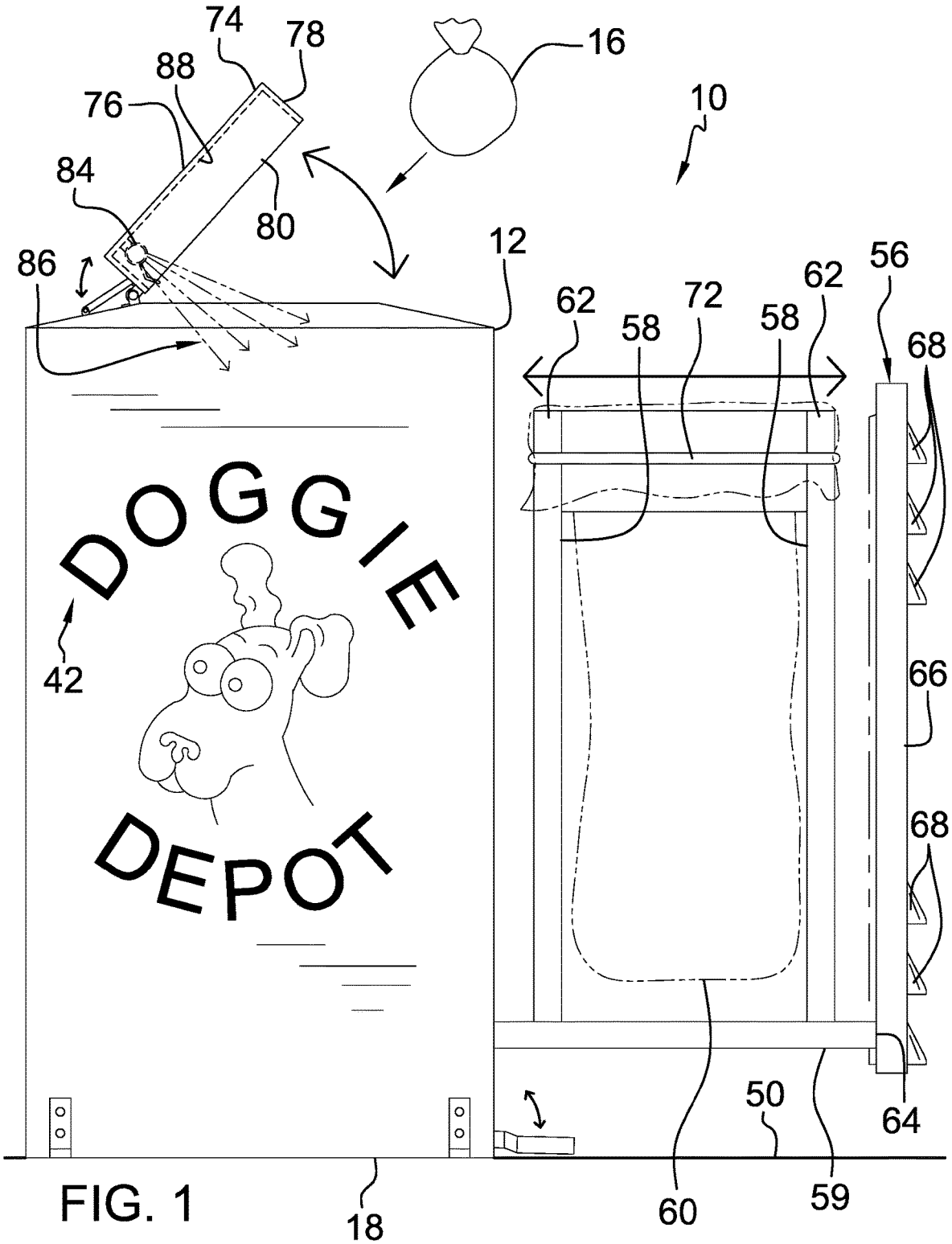
FIG. 1 is a right side view of an animal waste containment assembly according to an embodiment of the disclosure showing a drawer in an opened position.
Figure 2:
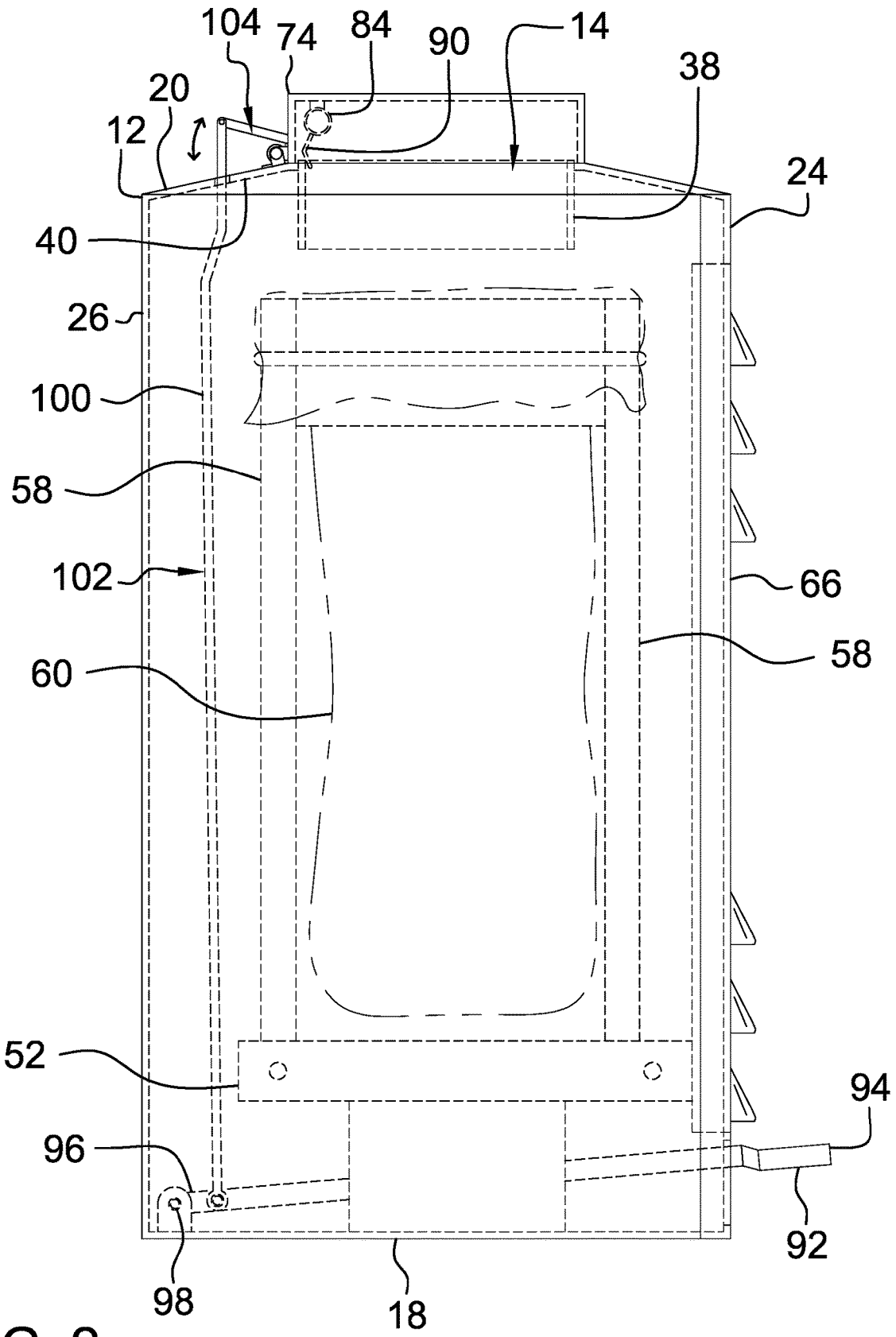
FIG. 2 is a right side phantom view of an embodiment of the disclosure.
Figure 3:
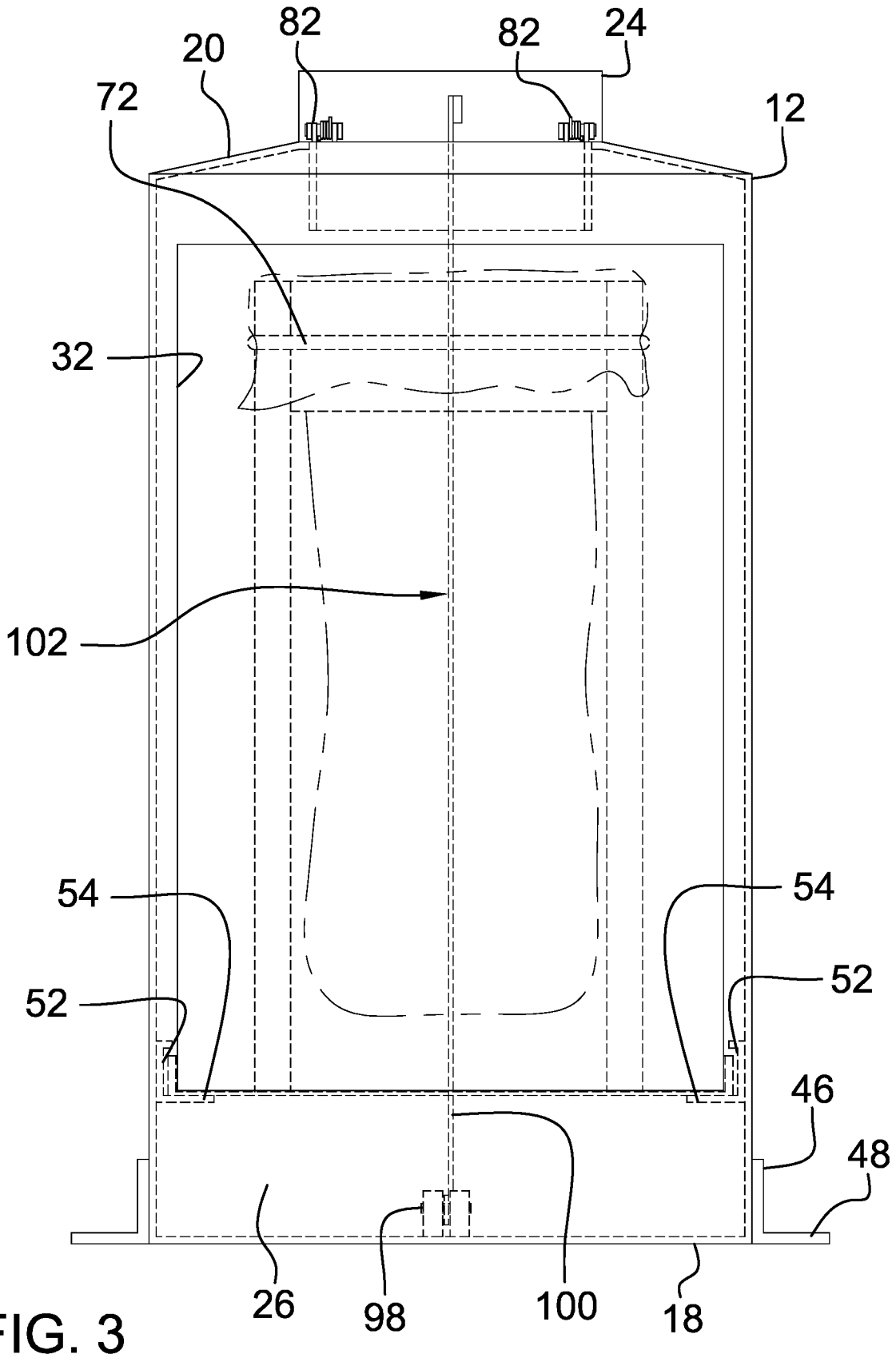
FIG. 3 is a back side phantom view of an embodiment of the disclosure.
Figure 4:
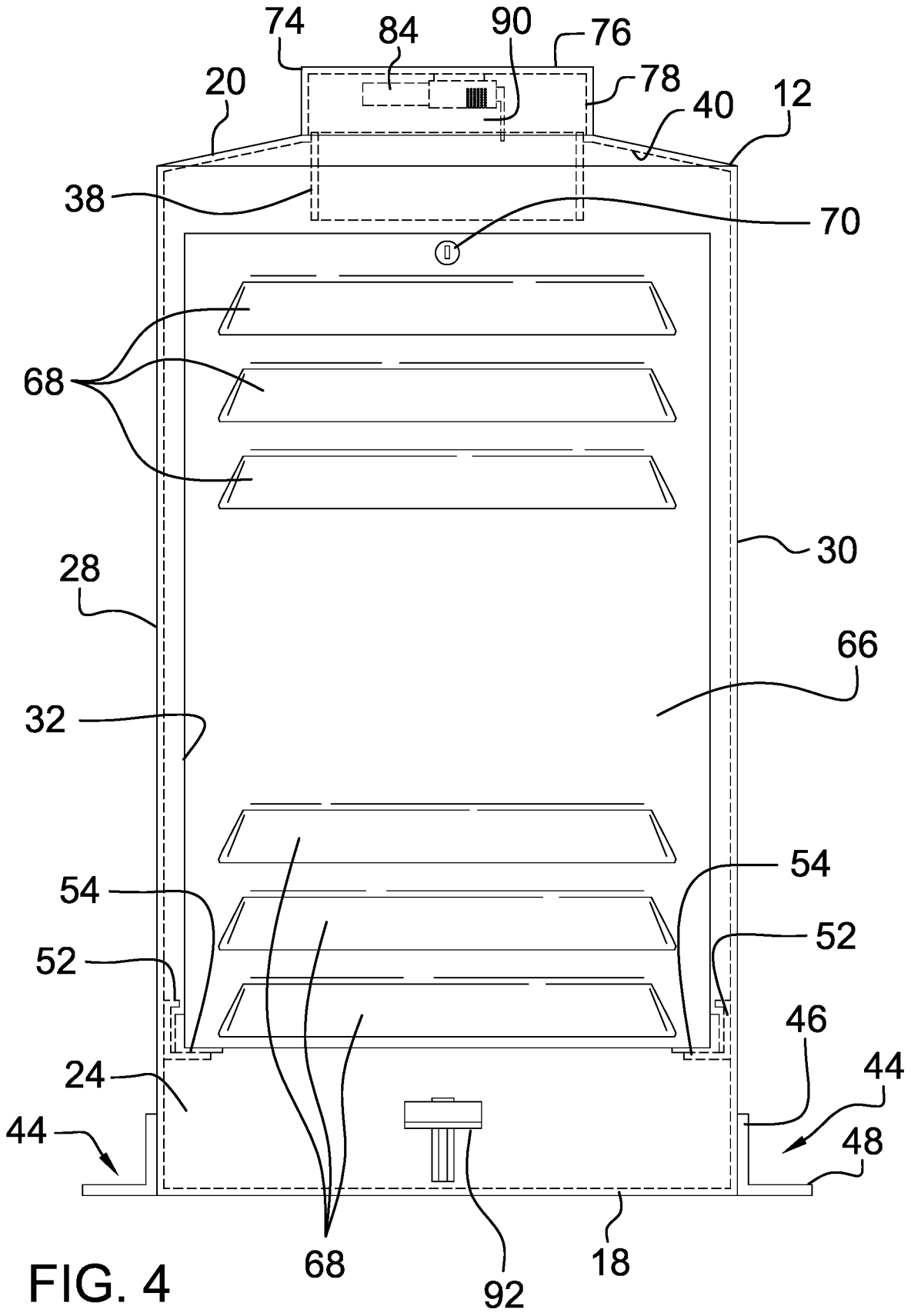
FIG. 4 is a front phantom view of an embodiment of the disclosure.
Figure 5:
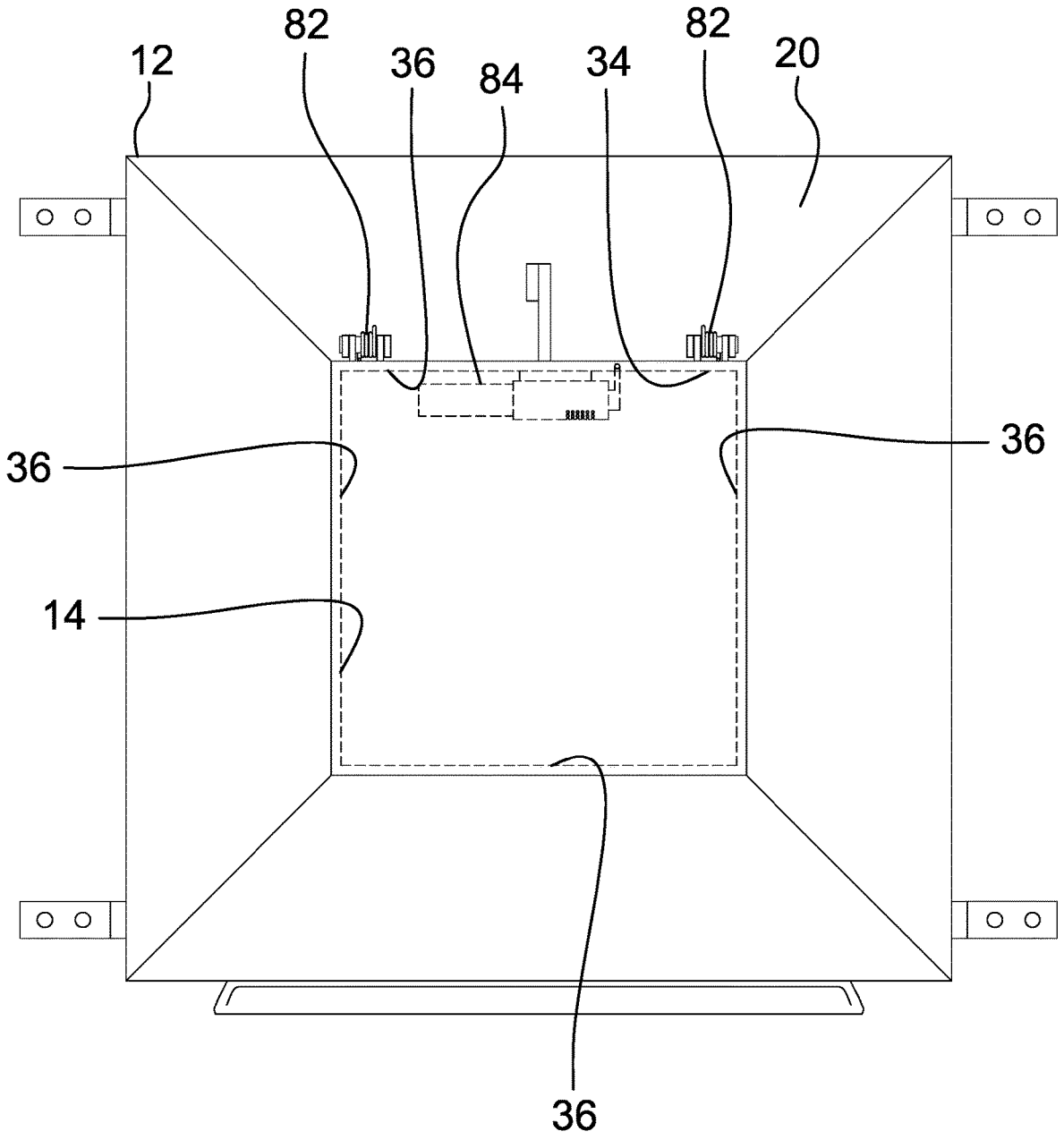
FIG. 5 is a top phantom view of an embodiment of the disclosure.

With reference now to the drawings, and in particular to FIGS. 1 through 5 thereof, a new waste containment device embodying the principles and concepts of an embodiment of the disclosure and generally designated by the reference numeral 10 will be described.

As best illustrated in FIGS. 1 through 5, the animal waste containment assembly 10 generally comprises a container 12 that is positioned outdoors such that the container 12 is accessible to people walking their pets. The container 12 has an opening 14 extending into an interior of the container 12 to facilitate the people to deposit bagged animal waste 16 into the container 12. The container 12 has a bottom wall 18, a top wall 20 and an outer wall 22 extending between the top wall 20 and the bottom wall 18, and the outer wall 22 has a front side 24, a back side 26, a first lateral side 28 and a second lateral side 30. The front side 24 has an entrance 32 extending into the interior of the container 12, and the entrance 32 extends substantially between the top wall 20 and the bottom wall 18. The opening 14 extends through the top wall 20, the opening 14 is centrally positioned on the top wall 20 and the opening 14 has a bounding edge 34.

Moreover, the bounding edge 34 has a plurality of intersecting sides 36 such that the opening 14 has a square shape.

The top wall 20 slopes upwardly between the outer wall 22 and the bounding edge 34 of the opening 14 to facilitate rain to run off of the top wall 20. A chute 38 is coupled to and extends downwardly from a bottom surface 40 of the top wall 20. The chute 38 is aligned with the opening 14 to direct the bagged animal waste 16 into the container 12. Indicia 42 are printed on the outer wall 22 and the indicia 42 may comprise the words "doggie depot" and the indicia 42 may include the image of a caricature of a domesticated dog.

A plurality of brackets 44 is provided and each of the brackets 44 includes a first section 46 forming an angle with a second section 48. The first section 46 is coupled to the outer wall 22 of the container 12 having the second section 48 of each of the brackets 44 extending laterally away from the outer wall 22. In this way the second section 48 of each of the brackets 44 can be attached to a support surface 50 upon which the container 12 is standing for securing the container 12 to the support surface 50. The support surface 50 may be a sidewalk, for example, or other horizontal support surface upon which the people and their pets are walking.

A pair of tracks 52 is each coupled to an inside surface 54 of a respective one of the first lateral side 28 and the second lateral side 30 of the outer wall 22 of the container 12. Each of the tracks 52 is oriented to extend substantially between the front side 24 and the back side 26 of the outer wall 22. Additionally, each of the tracks 52 is spaced from the bottom wall 18 and each of the tracks 52 has a first surface 54 that lies on a horizontal plane.

A drawer 56 is slidably integrated into the container 12 and the drawer 56 has a plurality of supports 58 each extending upwardly from a base 59 of the drawer 56 to support a garbage bag 60. The drawer 56 is positionable in a closed position having the plurality of supports 58 being aligned with the opening 14 in the container 12 to facilitate the bagged animal waste 16 to be deposited into the garbage bag 60. The drawer 56 is positionable in an opened position having the drawer 56 extending outwardly from the container 12 to facilitate the garbage bag 60 to be removed and replaced. The plurality of supports 58 is arranged to define a respective one of four corners of a rectangle on the base 59 having the garbage bag 60 being positioned inside of the rectangle. Additionally, the garbage bag 60 is wrapped over a top end 62 of each of the supports 58 for suspending the garbage bag 60 on the supports 58.

The base 59 has a front side 64 and the drawer 56 has a front panel 66 extending upwardly from the base 59 having the front panel 66 extending along the front side 24 of the base 59. The front panel 66 has a plurality of louvers 68 each being integrated into the front panel 66. The base 59 rests on the first surface 54 of each of the tracks 52 such that the base 59 is slidable between the front side 24 and the back side 26 of the outer wall 22 of the container 12. Additionally, the front panel 66 lies on a plane that is coplanar with the front side 24 of the outer wall 22 of the container 12 when the drawer 56 is in the closed position. The drawer 56 slides outwardly through the entrance 32 in the front side 24 of the outer wall 22 of the container 12 when the drawer 56 is positioned in the open position. The front panel 66 might include a lock 70 that engages the container 12 for locking the drawer 56 in the closed position.

An elastomeric band 72 is provided that is stretchable around the plurality of supports 58. The elastomeric band 72 compresses against a portion of the garbage bag 60 that is wrapped over the plurality of support for retaining the garbage bag 60 on the supports 58. A lid 74 is hingedly coupled to the container 12 and the lid 74 covers the opening 14 in the container 12 when the lid 74 is positioned in a closed position. Conversely, the lid 74 exposes the opening 14 in the container 12 when the lid 74 is positioned in an open position. The lid 74 has an upper wall 76 and an outside wall 78 extending downwardly from the upper wall 76, and the outside wall 78 is hingedly coupled to the top wall 20 of the container 12. A distal edge 80 of the outside wall 78 rests against the top wall 20 when the lid 74 is in the closed position.

A pair of biasing members 82 is each mechanically coupled between the lid 74 and the top wall 20 of the housing. Each of the biasing members 82 biases the lid 74 into the closed position. A deodorizer dispenser 84 is disposed on the lid 74 and the deodorizer dispenser 84 contains a chemical deodorant 86. The deodorizer dispenser 84 is actuated to dispense a measured amount of the chemical deodorant 86 when the lid 74 is opened. In this way the chemical deodorant 86 can conceal the odor of the bagged animal waste 16 stored inside the container 12 when the person is depositing the bagged animal waste 16 into the container 12.

The deodorizer dispenser 84 is positioned on a bottom surface 88 of the upper wall 76 of the lid 74. The deodorizer dispenser 84 includes an actuator 90 that extends downwardly on the lid 74. The actuator 90 engages the top wall 20 of the container 12 when the lid 74 is in the closed position. Moreover, the actuator 90 actuates the deodorizer dispenser 84 to dispense the chemical deodorant 86 when the actuator 90 disengages the top wall 20 of the container 12.

A foot pedal 92 is movably disposed in the container 12 such that the foot pedal 92 can be stepped on by the person walking their pet, and the foot pedal 92 has a first end 94 and a second end 96. The foot pedal 92 extends through the front side 24 of the outer wall 22 of the container 12 such that the first end 94 is exposed and the second end 96 is positioned inside the container 12. The second end 96 pivotally engages a pivot point 98 located on the bottom wall 18 of the container 12. A linkage 100 is movably coupled between the foot pedal 92, and the lid 74 and the lid 74 is urged into the open position when the foot pedal 92 is stepped upon. In this way the linkage 100 facilitates the person to deposit the bagged animal waste 16 into the container 12. The linkage 100 includes a first portion 102 that pivotally engages a second portion 104. The first portion 102 is pivotally coupled to the foot pedal 92 at a point that located adjacent to the second end 96 of the foot pedal 92. The first portion 102 extends upwardly through the top wall 20 of the container 12 and the second portion 104 is pivotally coupled to the outside wall 78 of the lid 74.

In use, the container 12 is positioned in a public location such that the container 12 is accessible to people that are walking their pets. The person steps on the foot pedal 92 to open the lid 74 to facilitate the person to deposit the bagged animal waste 16 into the container 12. In this way the bagged animal waste 16 can be collected for subsequently disposal at a waste handling facility. Additionally, the deodorizer dispenser 84 releases the measured amount of the chemical deodorant 86 each time the lid 74 is opened. In this way the chemical deodorant 86 masks the odor of the bagged animal waste 16 that is already inside of the container 12 when the person deposits their bagged animal waste 16 into the container 12. The drawer 56 is slid into the open position to facilitate the garbage bag 60 to be removed and replaced when the garbage bag 60 is full.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An animal waste containment assembly for containing bagged animal waste for subsequent collection, said assembly comprising:

a container being positioned outdoors wherein said container is accessible to people walking their pets, said container having an opening extending into an interior of said container wherein said opening is configured to facilitate the people to deposit bagged animal waste into said container;

a drawer being slidably integrated into said container, said drawer having a plurality of supports each extending upwardly from a base of said drawer wherein each of said supports is configured to support a garbage bag, said drawer being positionable in a closed position having said plurality of supports being aligned with said opening in said container wherein said drawer is configured to facilitate the bagged animal waste to be deposited into the garbage bag, said drawer being positionable in an opened position having said drawer extending outwardly from said container wherein said drawer is configured to facilitate the garbage bag to be removed and replaced;

a lid being hingedly coupled to said container, said lid covering said opening in said container when said lid is positioned in a closed position, said lid exposing said opening in said container when said lid is positioned in an open position;

a deodorizer dispenser being disposed on said lid, said deodorizer dispenser containing a chemical deodorant, said deodorizer dispenser being actuated to dispense a measured amount of said chemical deodorant when said lid is opened wherein said chemical deodorant is configured to conceal the odor of the bagged animal waste stored inside said container;

a foot pedal being movably disposed in said container wherein said foot pedal is configured to be stepped on by the person walking their pet;

a linkage being movably coupled between said foot pedal and said lid, said lid being urged into said open position when said foot pedal is stepped upon wherein said linkage is configured to facilitate the person to deposit the bagged animal waste into said container;

wherein said container has a bottom wall, a top wall and an outer wall extending between said top wall and said bottom wall, said outer wall having a front side, a back side, a first lateral side and a second lateral side;

wherein said front side has an entrance extending into said interior of said container, said entrance extending substantially between said top wall and said bottom wall;

wherein said opening extends through said top wall, said opening being centrally positioned on said top wall, said opening having a bounding edge, said bounding edge having a plurality of intersecting sides such that said opening has a square shape;

wherein said top wall slopes upwardly between said outer wall and said bounding edge of said opening wherein said top wall is configured to facilitate rain to runoff of said top wall; and wherein said top wall having a chute being coupled to and extending downwardly from a bottom surface of said top wall, said chute being aligned with said opening wherein said chute is configured to direct the bagged animal waste into said container.

2. The assembly according to claim 1, further comprising a plurality of brackets, each of said brackets including a first section forming an angle with a second section, said first section being coupled to said outer wall of said container having said second section of each of said brackets extending laterally away from said outer wall wherein said second section of each of said brackets is configured to be attached to a support surface upon which said container is standing for securing said container to the support surface.

3. The assembly according to claim 1, further comprising a pair of tracks, each of said tracks being coupled to an inside surface of a respective one of said first lateral side and said second lateral side of said outer wall of said container, each of said tracks being oriented to extend substantially between said front side and said back side of said outer wall, each of said tracks being spaced from said bottom wall, each of said tracks having a first surface lying on a horizontal plane.

4. The assembly according to claim 3, wherein:

said plurality of supports is arranged to define a respective one of four corners of a rectangle on said base having the garbage bag being positioned inside of said rectangle, said base having a front side;

said drawer has a front panel extending upwardly from said base having said front panel extending along said front side of said base, said front panel having a plurality of louvers each being integrated into said front panel; and said base rests on said first surface of each of said tracks such that said base is slidable between said front side and said back side of said outer wall of said container, said front panel lying on a plane being coplanar with said front side of said outer wall of said container when said drawer is in said closed position.

5. The assembly according to claim 1, wherein:

said lid has an upper wall and an outside wall extending downwardly from said upper wall, said outside wall being hingedly coupled to said top wall of said container, a distal edge of said outside wall resting against said top wall when said lid is in said closed position;

a pair of biasing members each being mechanically coupled between said lid and said top wall of said housing, each of said biasing members biasing said lid into said closed position; and said deodorizer dispenser is positioned on a bottom surface of said upper wall of said lid, said deodorizer including an actuator extending downwardly on said lid, said actuator engaging said top wall of said container when said lid is in said closed position, said actuator actuating said deodorizer to dispense said chemical deodorant when said actuator disengages said top wall of said container.

6. The assembly according to claim 1, wherein:

said foot pedal has a first end and a second end, said foot pedal extending through said front side of said outer wall of said container such that said first end is exposed and said second end is positioned inside said container, said second end pivotally engaging a pivot point located on said bottom wall of said container; and said linkage includes a first portion pivotally engaging a second portion, said first portion being pivotally coupled to said foot pedal at a point located adjacent to said second end of said foot pedal, said first portion extending upwardly through said top wall of said container, said second portion being pivotally coupled to said outside wall of said lid.

7. An animal waste containment assembly for containing bagged animal waste for subsequent collection, said assembly comprising:

a container being positioned outdoors wherein said container is accessible to people walking their pets, said container having an opening extending into an interior of said container wherein said opening is configured to facilitate the people to deposit bagged animal waste into said container, said container having a bottom wall, a top wall and an outer wall extending between said top wall and said bottom wall, said outer wall having a front side, a back side, a first lateral side and a second lateral side, said front side having an entrance extending into said interior of said container, said entrance extending substantially between said top wall and said bottom walk said opening extending through said top wall, said opening being centrally positioned on said top wall, said opening having a bounding edge, said bounding edge having a plurality of intersecting sides such that said opening has a square shape, said top wall sloping upwardly between said outer wall and said bounding edge of said opening wherein said top wall is configured to facilitate rain to runoff of said top wall, said top wall having a chute being coupled to and extending downwardly from a bottom surface of said top wall, said chute being aligned with said opening wherein said chute is configured to direct the bagged animal waste into said container;

a plurality of brackets, each of said brackets including a first section forming an angle with a second section, said first section being coupled to said outer wall of said container having said second section of each of said brackets extending laterally away from said outer wall wherein said second section of each of said brackets is configured to be attached to a support surface upon which said container is standing for securing said container to the support surface;

a pair of tracks, each of said tracks being coupled to an inside surface of a respective one of said first lateral side and said second lateral side of said outer wall of said container, each of said tracks being oriented to extend substantially between said front side and said back side of said outer wall, each of said tracks being spaced from said bottom wall, each of said tracks having a first surface lying on a horizontal plane;

a drawer being slidably integrated into said container, said drawer having a plurality of supports each extending upwardly from a base of said drawer wherein each of said supports is configured to support a garbage bag, said drawer being positionable in a closed position having said plurality of supports being aligned with said opening in said container wherein said drawer is configured to facilitate the bagged animal waste to be deposited into the garbage bag, said drawer being positionable in an opened position having said drawer extending outwardly from said container wherein said drawer is configured to facilitate the garbage bag to be removed and replaced, said plurality of supports being arranged to define a respective one of four corners of a rectangle on said base having the garbage bag being positioned inside of said rectangle, said base having a front side, said drawer having a front panel extending upwardly from said base having said front panel extending along said front side of said base, said front panel having a plurality of louvers each being integrated into said front panel, said base resting on said first surface of each of said tracks such that said base is slidable between said front side and said back side of said outer wall of said container, said front panel lying on a plane being coplanar with said front side of said outer wall of said container when said drawer is in said closed position;

an elastomeric band being stretchable around said plurality of supports wherein said elastomeric band is configured to compress against a portion of the garbage bag that is wrapped over said plurality of support for retaining the garbage bag on said supports;

a lid being hingedly coupled to said container, said lid covering said opening in said container when said lid is positioned in a closed position, said lid exposing said opening in said container when said lid is positioned in an open position, said lid having an upper wall and an outside wall extending downwardly from said upper wall, said outside wall being hingedly coupled to said top wall of said container, a distal edge of said outside wall resting against said top wall when said lid is in said closed position;

a pair of biasing members each being mechanically coupled between said lid and said top wall of said housing, each of said biasing members biasing said lid into said closed position;

a deodorizer dispenser being disposed on said lid, said deodorizer dispenser containing a chemical deodorant, said deodorizer dispenser being actuated to dispense a measured amount of said chemical deodorant when said lid is opened wherein said chemical deodorant is configured to conceal the odor of the bagged animal waste stored inside said container, said deodorizer dispenser being positioned on a bottom surface of said upper wall of said lid, said deodorizer including an actuator extending downwardly on said lid, said actuator engaging said top wall of said container when said lid is in said closed position, said actuator actuating said deodorizer to dispense said chemical deodorant when said actuator disengages said top wall of said container;

a foot pedal being movably disposed in said container wherein said foot pedal is configured to be stepped on by the person walking their pet, said foot pedal having a first end and a second end, said foot pedal extending through said front side of said outer wall of said container such that said first end is exposed and said second end is positioned inside said container, said second end pivotally engaging a pivot point located on said bottom wall of said container; and a linkage being movably coupled between said foot pedal and said lid, said lid being urged into said open position When said foot pedal is stepped upon wherein said linkage is configured to facilitate the person to deposit the bagged animal waste into said container, said linkage including a first portion pivotally engaging a second portion, said first portion being pivotally coupled to said foot pedal at a point located adjacent to said second end of said foot pedal, said first portion extending upwardly through said top wall of said container, said second portion being pivotally coupled to said outside wall of said lid.

* * * * *